US006588889B2

(12) United States Patent
Jeanmaire

(10) Patent No.: US 6,588,889 B2
(45) Date of Patent: Jul. 8, 2003

(54) CONTINUOUS INK-JET PRINTING APPARATUS WITH PRE-CONDITIONED AIR FLOW

(75) Inventor: David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/906,489

(22) Filed: Jul. 16, 2001

(65) Prior Publication Data

US 2003/0016276 A1 Jan. 23, 2003

(51) Int. Cl.[7] ..... B41J 2/02
(52) U.S. Cl. ..... 347/77; 347/82
(58) Field of Search ..... 347/73, 74, 77, 347/81, 82, 28

(56) References Cited

U.S. PATENT DOCUMENTS

| | | | | |
|---|---|---|---|---|
| 3,596,275 A | | 7/1971 | Sweet | 347/74 |
| 3,972,051 A | | 7/1976 | Lundquist et al. | 347/74 |
| 4,097,872 A | | 6/1978 | Giordano et al. | 347/21 |
| 4,106,032 A | | 8/1978 | Miura et al. | 347/21 |
| 4,190,844 A | * | 2/1980 | Taylor | 347/82 |
| 4,228,442 A | | 10/1980 | Krull | 347/28 |
| 4,297,712 A | | 10/1981 | Lammers et al. | 347/21 |
| 4,728,969 A | | 3/1988 | Le et al. | 347/21 |
| 6,406,122 B1 | * | 6/2002 | Sharma et al. | 347/28 |

* cited by examiner

*Primary Examiner*—Anh T. N. Vo
(74) *Attorney, Agent, or Firm*—William R. Zimmerli

(57) ABSTRACT

A continuous stream ink jet printer is provided having an ink droplet forming mechanism for ejecting a stream of ink droplets having a selected one of at least two different volumes toward a print medium, a droplet deflector for producing a flow of gas that interacts with the ink droplet stream to separate droplets having different volumes, and a gas flow conditioner for preconditioning the gas flow produced by the deflector with a solvent vapor. The provision of a solvent vapor in the gas flow prevents or at least reduces changes in ink viscosity which could otherwise interfere with the recycling and filtering of ink droplets captured by the gutter of the printer.

22 Claims, 3 Drawing Sheets

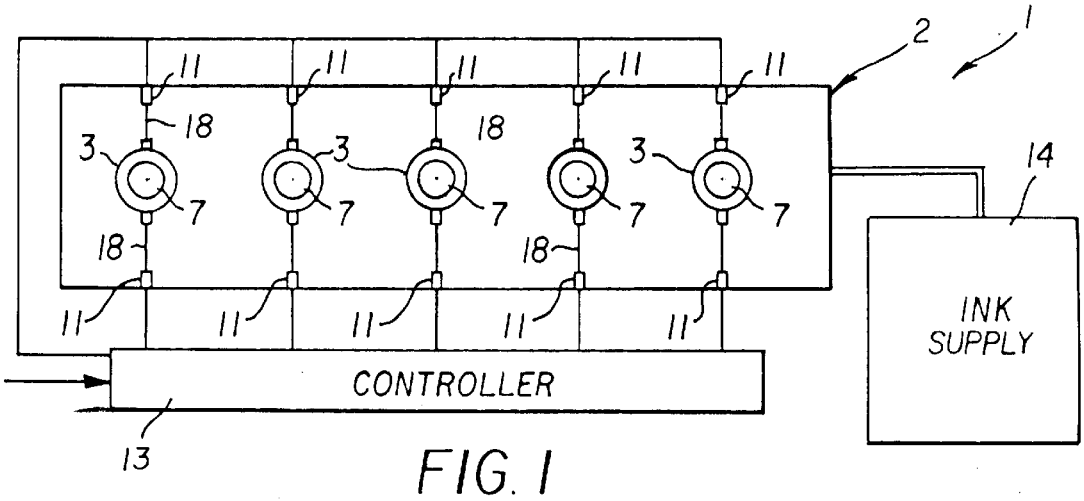
FIG. 1
FIG. 2A
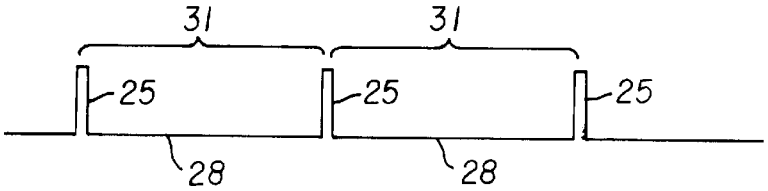
FIG. 2B
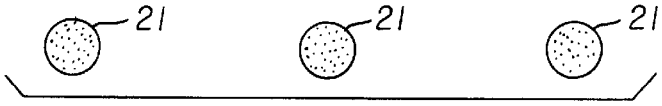
FIG. 2C
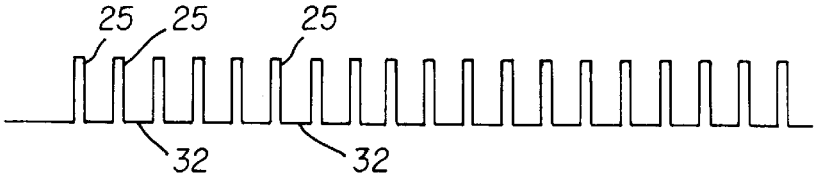
FIG. 2D
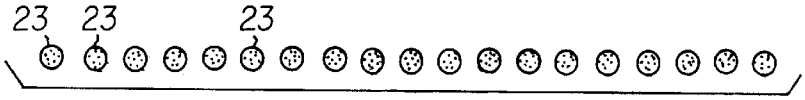
FIG. 2E
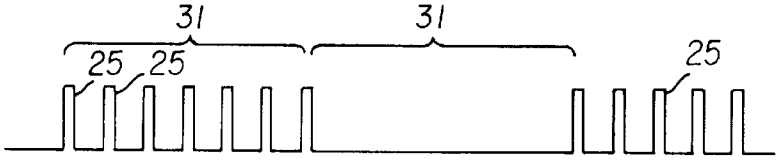
FIG. 2F
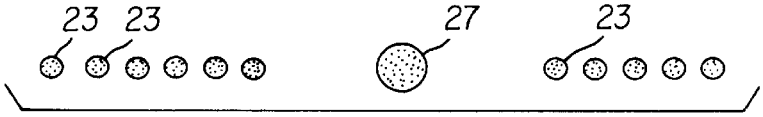

CONTINUOUS INK-JET PRINTING APPARATUS WITH PRE-CONDITIONED AIR FLOW

FIELD OF THE INVENTION

This invention relates generally to the field of digitally controlled continuous ink jet printing devices, and in particular to continuous ink jet printers in which the into droplets are selectively deflected by a transverse flow of gas that has been preconditioned with a solvent to minimize ink drying on the printhead. In both technologies, droplets of ink are ejected from nozzles in a printhead toward a print medium.

BACKGROUND OF THE INVENTION

Traditionally, color ink jet printing is accomplished by one of two technologies, referred to as drop-on-demand and continuous stream printing. Both technologies require independent ink supplies for each of the colors of ink provided. Ink is fed through channels formed in the printhead. Each channel includes a nozzle from which droplets of ink are selectively extruded and deposited upon a medium. Typically, each technology requires separate ink delivery systems for each ink color used in printing. Ordinarily, the three primary subtractive colors, i.e. cyan, yellow and magenta, are used because these colors can produce up to several million perceived color combinations.

In drop-on-demand ink jet printing, ink droplets are generated for impact upon a print medium using a pressurization actuator (thermal, piezoelectric, etc.). Selective activation of the actuator causes the formation and ejection of a flying ink droplet that crosses the space between the printhead and the print medium and strikes the print medium. The formation of printed images is achieved by controlling the individual formation of ink droplets as the medium is moved relative to the printhead. Typically, a slight negative pressure within each channel keeps the ink from inadvertently escaping through the nozzle, and also forms a slightly concave meniscus at the nozzle, thus helping to keep the nozzle clean.

Conventional drop-on-demand ink jet printers utilize a pressurization actuator to produce the ink jet droplet from the nozzles of a print head. Typically, one of two types of actuators are used including heat actuators and piezoelectric actuators. With heat actuators, a heater, placed at a convenient location, heats the ink. This causes a quantity of ink to phase change into a gaseous steam bubble that raises the internal ink pressure sufficiently for an ink droplet to be expelled. With piezoelectric actuators, an electric field is applied to a piezoelectric material possessing properties that create a pulse of mechanical movement stress in the material, thereby causing an ink droplet to be expelled by a pumping action. The most commonly produced piezoelectric materials are ceramics, such as lead zirconate titanate, barium titanate, lead titanate, and lead metaniobate.

The second technology, commonly referred to as continuous stream or continuous ink jet printing, uses a pressurized ink source for producing a continuous stream of ink droplets. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or discarded. When printing is desired, the ink droplets are not deflected and allowed to strike a print media. Alternatively, deflected ink droplets may be allowed to strike the print media, while non-deflected ink droplets are collected in the ink capturing mechanism. Typically, continuous ink jet printing devices are faster than drop on demand devices and produce higher quality printed images and graphics.

Other methods of continuous ink jet printing employ air flow in the vicinity of ink streams for various purposes. For example, U.S. Pat. No. 3,596,275 issued to Sweet in 1978 discloses the use of both collinear and perpendicular air flow to the droplet flow path to remove the effect of the wake turbulence on the path of succeeding droplets. This work was expanded upon in U.S. Pat. No. 3,972,051 to Lundquist et al., U.S. Pat. No. 4,097,872 to Hendriks et al. and U.S. Pat. No. 4,297,712 to Sturm in regards to the design of aspirators for use in droplet wake minimization. U.S. Pat. No. 4,106,032, to Miura and U.S. Pat. No. 4,728,969 to Le et al. employ a coaxial air flow to assist jetting from a drop-on-demand type head.

One problem associated with ink jet printers in general and such printers employing gas or air flows in particular, is the drying of the ink. Ink drying in the vicinity of the printhead nozzles can lead to spurious droplet trajectories and nozzle clogging. Additionally, the evaporation of the ink solvent from the droplets as they fly through the air can increase the viscosity of the ink captured by the gutter, thereby causing difficulties during the ink recycling operation when the recycled ink is passed through a filter. This last problem becomes particularly difficult if the loss of solvent in the ink is large enough to cause the pigments in the ink to coagulate.

Solvents have been introduced into the regions surrounding nozzles to prevent ink drying. For example, U.S. Pat. No. 4,228,442 to Krull teaches the use of absorbent or wick-like material disposed partly in a liquid ink solvent to evaporate solvent in front of or around the nozzles prevent drying or thickening of the ink at the nozzles. Miura et al discloses the use of humidified air to minimize nozzle clogging in an air assisted, drop on demand, ink jet printhead. However, none of the inventions described are sufficient to address the problems of solvent evaporation due to high-velocity air streams which interact with droplet streams in printers which employ the air streams to direct droplets along different trajectories according to drop volume.

Clearly, there is a need for a means of mitigating the drying effect that a gas flow has on the ink droplet streams in printers which involve gas flow interaction with ink droplets during printer operation. The primary problem is not the drying of ink at the nozzles, since the air flow in such printers is principally removed from the immediate vicinity of the nozzles. Rather, the difficulty is that the drying of droplets along their trajectory toward the ink catcher increases the viscosity to a point that impedes ink recycling and filtration.

SUMMARY OF THE INVENTION

The invention is an ink jet printing apparatus that solves or at least ameliorates all of the aforementioned problems associated with the prior art. To this end, the ink jet printing apparatus of the invention comprises an ink droplet forming mechanism for ejecting a stream of ink droplets having a selected one of at least two different volumes, a droplet deflector for producing a flow of gas that interacts with the ink droplet stream to separate ink droplets having different volumes from one another, and a gas flow conditioner for preconditioning with solvent vapor the gas flow produced by the droplet deflector.

Preferably, the ink jet printing apparatus is a continuous stream ink jet printer, and the flow of gas produced by the droplet deflector is oriented transversely to the stream of ink droplets and functions to deflect smaller volume droplets from larger volume droplets. The solvent used in the gas flow conditioner may be water, and the gas flow is preferably a flow of air.

The gas flow conditioner may include a sensor responsive to a solvent concentration level in the gas flow. The conditioner may also include a control circuit connected to the sensor for adjusting a solvent addition rate to the gas flow in order to maintain a selected solvent concentration in the gas flow.

In operation, the solvent concentration in the gas flow is set at a point that substantially prevents an increase in the viscosity of the ink in the droplets. Consequently, the droplets recaptured by the gutter of the printer may be filtered through the recycling mechanism of the printer without clogging the filter or interfering with the recycling operation.

BRIEF DESCRIPTION OF THE DRAWINGS

FIG. 1 is a schematic plan view of a printhead made in accordance with a preferred embodiment of the present invention;

FIGS. 2A–F illustrate the relationship between the switching frequency of the heaters of the printhead and the volume of ink droplets produced by the nozzles adjacent to the heaters.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 4:
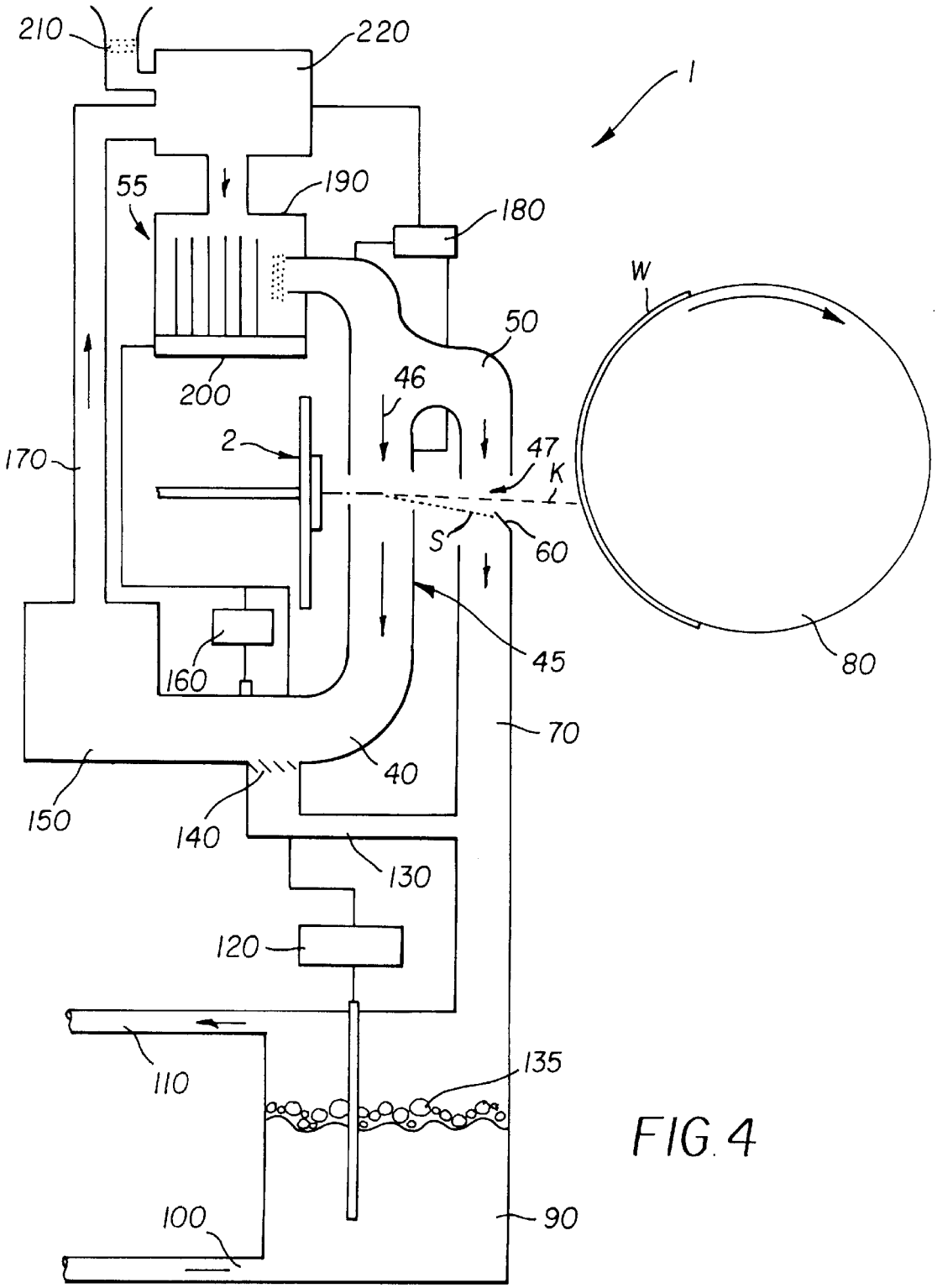
FIG. 4 is schematic side view of an ink jet printer made in accordance with a preferred embodiment of the present invention.

With reference to FIGS. 1 and 4, wherein like reference numerals designate like components throughout all of the several figures, the continuous stream printer of the invention generally comprises an ink droplet forming mechanism in the form of a printhead 2.

In a preferred embodiment of the present invention, printhead 2 is formed from a semiconductor material (silicon, etc.) using known semiconductor fabrication techniques (CMOS circuit fabrication techniques, micro-electro mechanical structure (MEMS) fabrication techniques, etc.). However, it is specifically contemplated and therefore within the scope of this disclosure that printhead 2 may be formed from any materials using any fabrication techniques conventionally known in the art.

Referring in particular to FIG. 1, a plurality of annular heaters 3 are at least partially formed or positioned on the silicon substrate 6 of the printhead 2 around corresponding nozzles 7. Although each heater 3 may be disposed radially away from an edge of a corresponding nozzles 7, the heaters 3 are preferably disposed close to corresponding nozzles 7 in a concentric manner. In a preferred embodiment, heaters 3 are formed in a substantially circular or ring shape. However, it is specifically contemplated that heaters 3 may be formed in a partial ring, square, or other shape adjacent to the nozzles 7. Each heater 3 in a preferred embodiment is principally comprised of a resistive heating element electrically connected to contact pads 11 via conductors 18. Each nozzle 7 is in fluid communication with ink supply 14 through an ink passage (not shown) also formed in printhead 2. It is specifically contemplated that printhead 2 may incorporate additional ink supplies in the same manner as supply 14 as well as additional corresponding nozzles 7 in order to provide color printing using three or more ink colors. Additionally, black and white or single color printing may be accomplished using a single ink supply 14 and nozzle 7.

Conductors 18 and electrical contact pads 11 may be at least partially formed or positioned on the printhead 2 and provide an electrical connection between a controller 13 and the heaters 3. Alternatively, the electrical connection between the controller 13 and heater 3 may be accomplished in any well known manner. Controller 13 may be a relatively simple device (a switchable power supply for heater 3, etc.) or a relatively complex device (a logic controller or programmable microprocessor in combination with a power supply) operable to control many other components of the printer in a desired manner.

In FIGS. 2A–F, examples of the electrical activation waveforms provided by controller 13 to the heaters 3 are shown. Generally, a high frequency of activation of heater 3 results in small volume droplets 23 as shown in FIGS. 2C and 2D, while a low frequency of activation results in large volume droplets 21 as illustrated in FIGS. 2A and 2B. In the preferred embodiment, large ink droplets are to be used for marking the print medium, while smaller droplets are captured for ink recycling. It must be understood, however, that this could be reversed in operation (depending on imaging requirements), where the smaller droplets are used for printing, and the larger drops recycled. Also in this example, only one printing droplet is provided for per image pixel, thus there are two states of heater actuation, printing or non-printing. The electrical waveform of heater 3 actuation for large ink droplets 21 is presented schematically as FIG. 2(*a*). The individual large ink drops 21 produced from the jetting of ink from nozzle 7 as a result of low frequency heater actuation are shown schematically in 2B. Heater actuation time 25 is typically 0.1 to 5 microseconds in duration, and in this example is 1.0 microsecond. The delay time 28 between subsequent heater actuation is 42 microseconds. The electrical waveform of heater 3 actuation for the non-printing case is given schematically as FIG. 2(*c*). Electrical pulse 25 is 1.0 microsecond in duration, and the time delay 32 between activation pulses is 6.0 microseconds. The small droplets 23, as illustrated in FIG. 2D, are the result of the activation of heater 3 with this non-printing waveform.

FIG. 2(*e*) is a schematic representation of an electrical waveform of heater activation for mixed image data where a transition is shown from the non-printing state to the printing state, and back to the non-printing state. Schematic representation FIG. 2F is the resultant droplet stream formed. It is apparent that heater activation may be controlled independently based on the ink color required and ejected through corresponding nozzle 7, the movement of printhead 17 relative to a print media W, and an image to be printed. It is specifically contemplated that the absolute volume of the small droplets 23 and the large droplets 21 may be adjusted based upon specific printing requirements such as ink and media type or image format and size.

Figure 3:
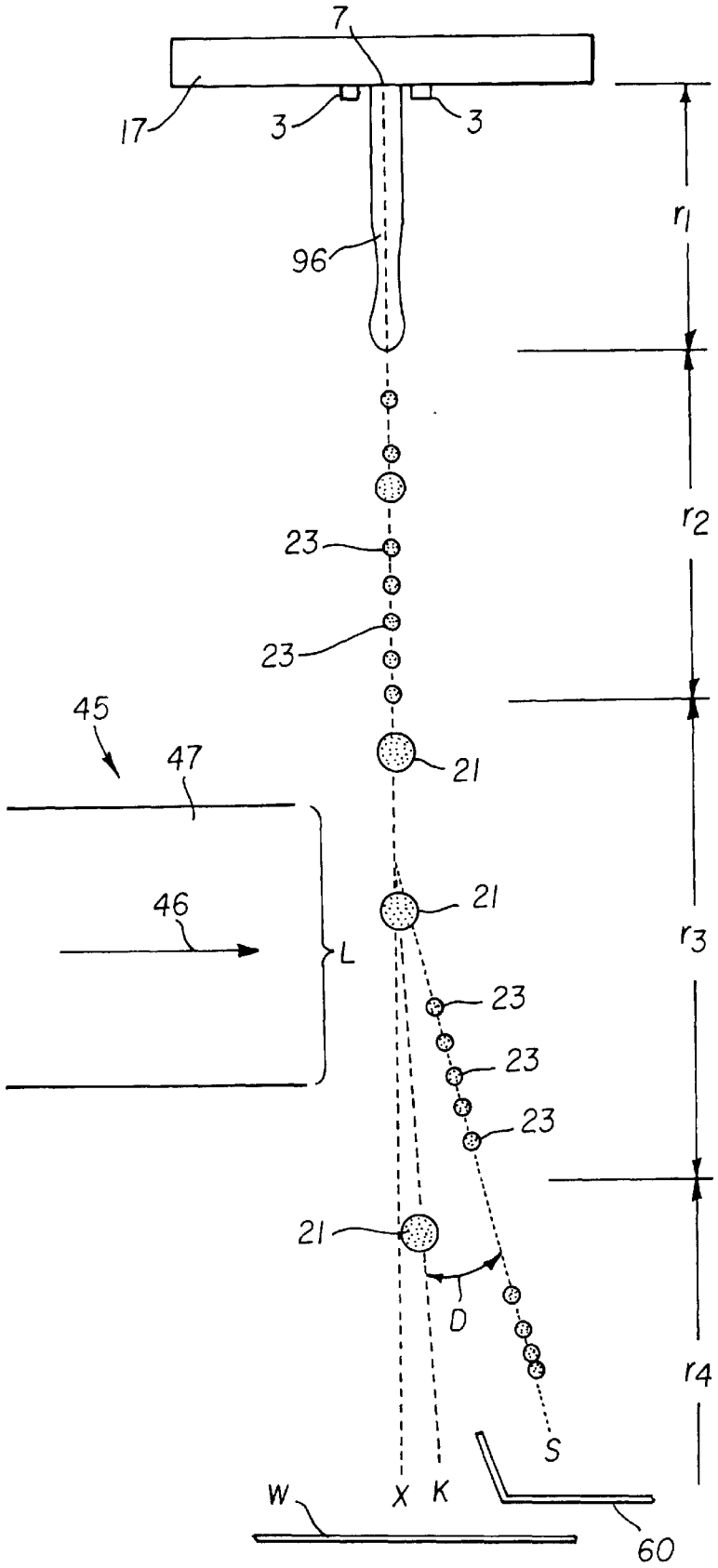
FIG. 3 is a schematic side view of the operation of an ink jet printhead made in accordance with the preferred embodiment of the present invention illustrating how the droplet deflector deflects smaller volume droplets from larger volume droplets.

With reference now to FIG. 3, the operation of printhead 2 in a manner such as to provide an image-wise modulation of droplets, as described above, is coupled with a droplet deflector 45 which separates droplets into printing or non-printing paths according to drop volume by means of a transversely disposed gas flow 47. Ink is ejected through nozzle 7 in printhead 2, creating a filament of working fluid 96 moving substantially perpendicular to printhead 2 along axis X. The physical region over which the filament of working fluid is intact is designated as $r_1$. Heater 3 is selectively actuated at various frequencies according to image data, causing filament of working fluid 96 to break up into a stream of individual ink droplets. Some coalescence of droplets often occurs in forming non-printing drops 21. This region of jet break-up and drop coalescence is designated as $r_2$. Following region $r_2$, drop formation is complete in region $r_3$, such that at the distance from the printhead 2 that the gas flow from the deflector 45 is applied, droplets are substantially in two size classes: small, printing drops 23 and large, non-printing drops 21. In the preferred implementation, the force 46 provided by the gas flow 47 is perpendicular to axis X. The force 46 acts across distance L, which is less than or equal to distance $r_3$. Because area increases with the square of the radius of a sphere while mass increases with the cube of the radius, large, non-printing droplets 21 have a greater mass and more momentum than small volume droplets 23 which more than offsets the greater force applied to them by the gas flow as a result of their layer area. As gas force 46 interacts with the stream of ink droplets, the individual ink droplets separate depending on each droplets volume and mass. Accordingly, the gas flow rate can be adjusted to create a sufficient differentiation angle D in the small droplet path S from the large droplet path K, permitting large droplets 21 to strike print media W while small, non-printing droplets 23 are captured by a ink guttering structure 60 described in more detail in the apparatus below.

An amount of separation D between the large, non-printing droplets 21 and the small, printing droplets 23 will not only depend on their relative size but also the velocity, density, and viscosity of the gas flow producing force 46; the velocity and density of the large printing droplets 21 and small, non-printing droplets 23; and the interaction distance (shown as L in FIG. 3) over which the large printing droplet 21 and the small, non-printing droplets 23 interact with the gas flow 47. Gases, including air, nitrogen, etc., having different densities and viscosities can also be used with similar results.

Referring to FIGS. 3 and 4, a printing apparatus (typically, an ink jet printer or printhead) used in a preferred implementation of the current invention is shown schematically. Large volume ink droplets 21 and small volume ink droplets 23 are formed from ink ejected from printhead 17 substantially along ejection path X in a stream. The droplet deflector 45 contains lower plenum 40 which facilitates a laminar flow of gas. Vacuum pump 150 communicates with plenum 40 and provides a sink for the gas flow 47. In the center of the droplet deflector 45 is positioned proximate path X. The application of force 46 due to gas flow 47 separates the ink droplets into small-drop path S and large-drop path K. An upper plenum 50 is disposed opposite the plenum 40 and promotes laminar gas flow while protecting the droplet stream moving along path X from external air disturbances. Pump 220 draws in air, while filter 210 removes dust and dirt particles.

The printing apparatus further includes a gas flow conditioner 55 for providing a selected concentration of solvent into the gas flow 47 generated by the droplet deflector 45. Gas flow conditioner 55 includes a conditioning chamber 190 that contains a supply of liquid solvent, which may be water in a case where aqueous inks are used in the printhead 2, and a heater 200 for evaporating the solvent and for compensating for the cooling effect of solvent evaporation. Pressurized air from pump 220 enters conditioning chamber 190 where vaporized solvent and is mixed with the air. Separator filter 190 prevents any solvent droplets from entering upper plenum 50. Differential pressure sensor 180 is used to determine the air flow rate through plenum 50 and a control signal is fed to pump 220 so that constant air flow rate is maintained. Air conditioned with solvent which has been used in droplet separator 45 and drawn into vacuum pump 150 is recirculated back into pump 220 in order to minimize solvent consumption. Sensor 160 senses solvent concentration in the air flow, and in a preferred implementation where aqueous inks are employed, is a capacitive-type humidity sensor as is well known in the art. A signal from sensor 160 is used to control heater 200, thereby adjusting the solvent evaporation rate, and hence, the solvent concentration in the air flow in droplet separator 45.

An ink recovery conduit 70 contains a ink guttering structure 60 whose purpose is to intercept the path of small droplets 23, while allowing large ink droplets 21 traveling along small droplet path K to continue on to the recording media W carried by print drum 80. Ink recovery conduit 70 communicates with ink recovery reservoir 90 to facilitate recovery of non-printed ink droplets by an ink return line 100 for subsequent reuse. Ink recovery reservoir contains open-cell sponge or foam 135 which prevents ink sloshing in applications where the printhead 17 is rapidly scanned. A vacuum conduit 110, coupled to a negative pressure source can communicate with ink recovery reservoir 90 to create a negative pressure in ink recovery conduit 70 improving ink droplet separation and ink droplet removal. The gas flow rate in ink recovery conduit 70, however, is chosen so as to not significantly perturb large droplet path K. Lower plenum 40 is fitted with filter 140 and drain 130 to capture any ink fluid resulting from ink misting, or misdirected jets which has been captured by the air flow in plenum 40. Captured ink is then returned to recovery reservoir 90.

Ink recovery reservoir 90 is fitted with a sensor 120 which measures the electrical conductivity of the ink in reservoir 90. Generally, as solvent is lost from the ink due to interaction with the gas flow, the concentration of an ionic colorant will increase, and consequently cause a rise in electrical conductivity of the recovered ink. A control signal from sensor 120, in combination with the control signal from solvent sensor 160 in a cascade loop configuration, is applied to heater 200, so that the ink may have a solvent concentration in the range suitable for re-use without further need for make-up solvent additions in recycling.

Additionally, a portion of plenum 50 diverts a small fraction of the gas flow from pump 220 and conditioning chamber 190 to provide a source for the gas which is drawn into ink recovery conduit 70. The gas pressure in droplet deflector 45 and in ink recovery conduit 70 are adjusted in combination with the design of ink recovery conduit 70 and plenum 50 so that the gas pressure in the print head assembly near ink guttering structure 60 is positive with respect to the ambient air pressure near print drum 80. Environmental dust and paper fibers are thusly discouraged from approaching and adhering to ink guttering structure 60 and are additionally excluded from entering ink recovery conduit 70

In operation, a recording medium W is transported in a direction transverse to axis x by print drum 80 in a known manner. Transport of recording medium W is coordinated with movement of print mechanism 10 and/or movement of printhead 17. This can be accomplished using controller 13 in a known manner. Recording media W may be selected from a wide variety of materials including paper, vinyl, cloth, other fibrous materials, etc.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

Parts List

1 continuous stream printer
2 printhead
3 heater
6 silicon substrate
7 nozzle
11 electrical contact pad
12 printing apparatus
13 controller
14 ink supply
21 large drop
23 small drop
25 electrical pulse time
28 delay time
31 pixel time
32 delay time
40 lower plenum
45 droplet deflector
46 force
47 gas flow
50 upper plenum
60 ink guttering structure
70 ink recovery conduit
80 print drum
90 ink recovery reservoir
96 working fluid
100 ink return line
110 vacuum conduit
120 ink conductivity sensor
130 ink return line
135 foam
140 filter
150 vacuum pump
160 solvent sensor
170 gas recycling line
180 differential pressure sensor
190 separation filter
200 heater
210 intake filter
220 pressure pump
W print media
L interaction distance
D separation distance
X ejection path
S small droplet path
K large droplet path

What is claimed is:

1. An ink jet printing apparatus comprising:

an ink droplet forming mechanism for ejecting a stream of ink droplets having a selected one of at least two different volumes toward a print medium;

a droplet deflector for producing a flow of gas that interacts with said ink droplet stream to separate ink droplets having said different volumes from one another, and a gas flow conditioner for preconditioning with solvent vapor the gas flow produced by said droplet deflector.

2. The ink jet printing apparatus defined in a claim 1, wherein said apparatus is a continuous stream ink jet printer.

3. The ink jet printing apparatus defined in a claim 1, wherein said flow of gas produced by said droplet deflector is oriented transversely to said stream of ink droplets and functions to deflect smaller volume droplets from larger volume droplets.

4. The ink jet printing apparatus defined in a claim 1, further comprising a catcher for collecting one of said two different volumed ink droplets after said gas flow deflects droplets of one volume from droplets of a different volume.

5. The ink jet printing apparatus defined in a claim 1, wherein said solvent is water.

6. The ink jet printing apparatus defined in a claim 1, wherein said gas flow is a flow of air.

7. The ink jet printing apparatus defined in a claim 6, wherein said gas flow is a laminar flow of air.

8. The ink jet printing apparatus defined in a claim 1, wherein said gas flow conditioner includes a sensor responsive to a solvent concentration in said gas flow.

9. The ink jet printing apparatus defined in a claim 8, wherein said gas flow conditioner includes a control circuit connected to said sensor for adjusting a solvent addition rate to said gas flow to maintain a selected solvent concentration in said flow.

10. The ink jet printing apparatus defined in a claim 1, wherein said ink droplet forming mechanism includes a printhead with nozzles for ejecting said droplets and said gas flow conditioner preconditions said gas flow with sufficient solvent to reduce ink drying around said nozzles and to prevent substantial changes in ink viscosity.

11. A continuous stream ink printing apparatus, comprising:

an ink jet droplet forming mechanism for ejecting a stream of ink droplets having a selected one of at least two different volumes toward a print medium;

a droplet deflector for producing a flow of gas that transversely interacts with said droplet stream to separate ink droplets having said different volumes from one another, and a gas flow conditioner for preconditioning with solvent vapor the gas flow produced by said droplet deflector.

12. The ink jet printing apparatus defined in a claim 11, wherein said ink jet droplet forming mechanism includes a printhead having at least one nozzle for ejecting said droplet stream, and said gas flow conditioner preconditions said gas flow with solvent sufficient to substantially reduce ink drying around said nozzles.

13. The ink jet printing apparatus defined in a claim 12, further comprising an ink recycling system for recaptured ink droplets, and wherein said gas flow conditioner preconditions said gas flow with solvent sufficient to substantially prevent a viscosity of ink forming said recaptured droplets from increasing.

14. The ink jet printing apparatus defined in a claim 12, wherein said printhead includes a heater disposed adjacent to said nozzle for controlling said droplet volume.

15. The ink jet printing apparatus defined in a claim 11, wherein said solvent is water.

16. The ink jet printing apparatus defined in a claim 11, wherein said gas flow is a flow of air.

17. The ink jet printing apparatus defined in a claim 16, wherein said gas flow is a laminar flow of air.

18. The ink jet printing apparatus defined in a claim 11, wherein said gas flow conditioner includes a control circuit connected to a sensor for adjusting a solvent addition rate to said gas flow to maintain a selected solvent concentration in said flow.

19. An ink jet printing apparatus comprising:

an ink droplet forming mechanism for ejecting a stream of ink droplets having a selected one of at least two different volumes toward a print medium;

a droplet deflector for producing a flow of gas that interacts with said ink droplet stream to separate ink droplets having said different volumes from one another, and a gas flow conditioner for preconditioning with solvent vapor the gas flow produced by said droplet deflector, wherein said gas flow conditioner includes a sensor responsive to a solvent concentration in said gas flow.

20. The ink jet printing apparatus defined in a claim 19, wherein said gas flow conditioner includes a control circuit connected to said sensor for adjusting a solvent addition rate to said gas flow to maintain a selected solvent concentration in said flow.

21. A continuous stream ink printing apparatus, comprising:

an ink jet droplet forming mechanism for ejecting a stream of ink droplets having a selected one of at least two different volumes toward a print medium;

a droplet deflector for producing a flow of gas that transversely interacts with said droplet stream to separate ink droplets having said different volumes from one another, and a gas flow conditioner for preconditioning with solvent vapor the gas flow produced by said droplet deflector, wherein said gas flow conditioner includes a control circuit connected to a sensor for adjusting a solvent addition rate to said gas flow to maintain a selected solvent concentration in said flow.

22. The ink jet printing apparatus defined in a claim 21, wherein said gas flow is a laminar flow of air.

* * * * *